US011135855B2

(12) United States Patent
Takeuchi

(10) Patent No.: US 11,135,855 B2
(45) Date of Patent: Oct. 5, 2021

(54) IMAGE FORMING APPARATUS, AND NON-TRANSITORY COMPUTER READABLE RECORDING MEDIUM THAT RECORDS IMAGE FORMING PROGRAM

(71) Applicant: KYOCERA DOCUMENT SOLUTIONS INC., Osaka (JP)

(72) Inventor: Naoki Takeuchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 49 days.

(21) Appl. No.: 16/739,207

(22) Filed: Jan. 10, 2020

(65) Prior Publication Data

US 2020/0247139 A1 Aug. 6, 2020

(30) Foreign Application Priority Data

Jan. 31, 2019 (JP) ..... JP2019-014978

(51) Int. Cl.
*B41J 2/21* (2006.01)
*B41J 2/165* (2006.01)

(52) U.S. Cl.
CPC ..... *B41J 2/2142* (2013.01); *B41J 2/16579* (2013.01); *B41J 2/16585* (2013.01); *B41J 2002/16582* (2013.01)

(58) Field of Classification Search
CPC ..... B41J 2/16585; B41J 29/393; B41J 2/165; B41J 2002/16582; B41J 2/16517; B41J 2/16579; B41J 2/2142
See application file for complete search history.

(56) References Cited

U.S. PATENT DOCUMENTS

2006/0214979 A1* 9/2006 Inoue ..... B41J 2/16585 347/22

FOREIGN PATENT DOCUMENTS

| | | | |
|---|---|---|---|
| JP | H07125225 | A | 5/1995 |
| JP | H07125226 | A | 5/1995 |
| JP | H10138513 | A | 5/1998 |

* cited by examiner

*Primary Examiner* — Jannelle M Lebron
(74) *Attorney, Agent, or Firm* — Li & Cai Intellectual Property (USA) Office

(57) ABSTRACT

An image forming apparatus includes: a line head including multiple ink jet nozzles arrayed in a line direction; a storage device; and a controller circuit configured to determine an image width, the image width being a width of an image to be formed in the line direction, mandatorily eject ink from an ink jet nozzle group before forming the image, the ink jet nozzle group including multiple ink jet nozzles used to form the image having the image width out of the multiple ink jet nozzles, and store the image width in the storage device as a mandatory ejection width.

10 Claims, 3 Drawing Sheets

IMAGE FORMING APPARATUS, AND NON-TRANSITORY COMPUTER READABLE RECORDING MEDIUM THAT RECORDS IMAGE FORMING PROGRAM

CROSS-REFERENCE TO RELATED PATENT APPLICATION

This application claims the benefit of Japanese Priority Patent Application JP 2019-014978 filed Jan. 31, 2019, the entire contents of which are incorporated herein by reference.

FIELD OF THE DISCLOSURE

The present disclosure relates to an image forming apparatus including multiple ink jet nozzles, and a non-transitory computer readable recording medium that records an image forming program.

BACKGROUND OF THE DISCLOSURE

An image forming apparatus sometimes mandatorily ejects ink from ink jet nozzles in order not to reduce its print quality.

SUMMARY OF THE DISCLOSURE

Where an image forming apparatus mandatorily ejects ink from ink jet nozzles, it is desirable not to reduce its print quality more reliably and it is desirable to reduce waste of ink, i.e., a consumable item.

According to an embodiment of the present disclosure, there is provided an image forming apparatus, including:

a line head including multiple ink jet nozzles arrayed in a line direction;

a storage device; and a controller circuit configured to determine an image width, the image width being a width of an image to be formed in the line direction, mandatorily eject ink from an ink jet nozzle group before forming the image, the ink jet nozzle group including multiple ink jet nozzles used to form the image having the image width out of the multiple ink jet nozzles, and store the image width in the storage device as a mandatory ejection width.

According to an embodiment of the present disclosure, there is provided a non-transitory computer readable recording medium that records an image forming program executable by a controller circuit of an image forming apparatus, the image forming apparatus including a line head including multiple ink jet nozzles arrayed in a line direction, and a storage device, the image forming program causing the controller circuit of the image forming apparatus to determine an image width, the image width being a width of an image to be formed in the line direction, mandatorily eject ink from an ink jet nozzle group before forming the image, the ink jet nozzle group including multiple ink jet nozzles used to form the image having the image width out of the multiple ink jet nozzles, and store the image width in the storage device as a mandatory ejection width.

These and other objects, features and advantages of the present disclosure will become more apparent in light of the following detailed description of best mode embodiments thereof, as illustrated in the accompanying drawings.

DETAILED DESCRIPTION OF THE EXEMPLARY EMBODIMENTS

Hereinafter, an embodiment of the present disclosure will be described with reference to the drawings.

1. Hardware Configuration of Image Forming Apparatus

Figure 1:
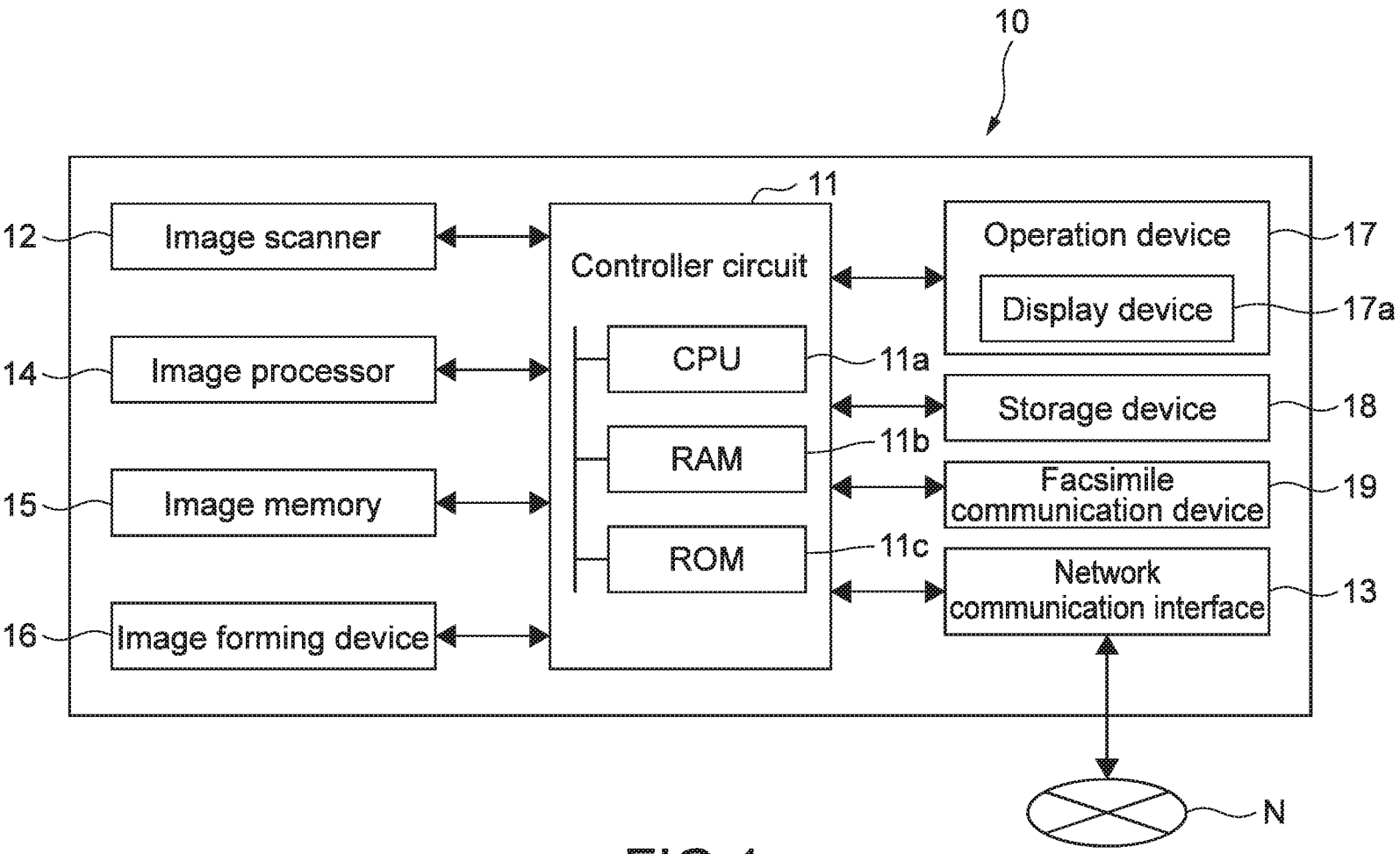
FIG. 1 shows a hardware configuration of an image forming apparatus.

FIG. 1 shows a hardware configuration of an image forming apparatus.

The image forming apparatus 10 includes the controller circuit 11. The controller circuit 11 includes the CPU (Central Processing Unit) 11*a*, the RAM (Random Access Memory) 11*b*, the ROM (Read Only Memory) 11*c*, dedicated hardware circuits, and the like and performs overall operational control of the image forming apparatus 10. The CPU 11*a* loads information processing programs stored in the ROM 11*c* in the RAM 11*b* and executes the information processing programs. The ROM 11*c* is a nonvolatile memory that stores programs executed by the CPU 11*a*, data, and the like. The ROM 11*c* is an example of a non-transitory computer readable recording medium.

The controller circuit 11 is connected to the image scanner 12, the image processor 14 (including GPU (Graphics Processing Unit)), the image memory 15, the image forming device 16 (printer), the operation device 17 including the display device 17*a* (touch panel), the large volume nonvolatile storage device 18 such as an HDD (Hard Disk Drive) or an SSD (Solid State Drive), the facsimile communication device 19, the network communication interface 13, and the like. The controller circuit 11 performs operational control of the respective devices connected thereto and sends/receives signals and data to/from those devices. The operation device 17 (touch panel) is one mode of an input device. A sound input device including a microphone may be provided as an input device.

Typically, the image forming apparatus 10 is a line head printer. The image forming device 16 includes a line head. The line head includes multiple ink jet nozzles arrayed in a line direction. The "line direction" is a direction approximately orthogonal (typically, orthogonal) to a convey direction of a medium (typically, sheet of paper. The same applies to the following description). The controller circuit 11 ejects ink on a medium from the multiple ink jet nozzles to form an image on the medium.

Further, the controller circuit 11 mandatorily ejects ink on a medium (medium being unused sheet) from the multiple ink jet nozzles for maintenance of the multiple ink jet nozzles. Hereinafter, to "mandatorily eject" merely means to mandatorily eject ink on a medium from multiple ink jet nozzles for maintenance of the multiple ink jet nozzles. When ink is "mandatorily ejected", an image including lines, which has no relation with an image to be formed, is formed on the approximately entire area of a medium.

2. Functional Configuration of Image Forming Apparatus

Figure 2:
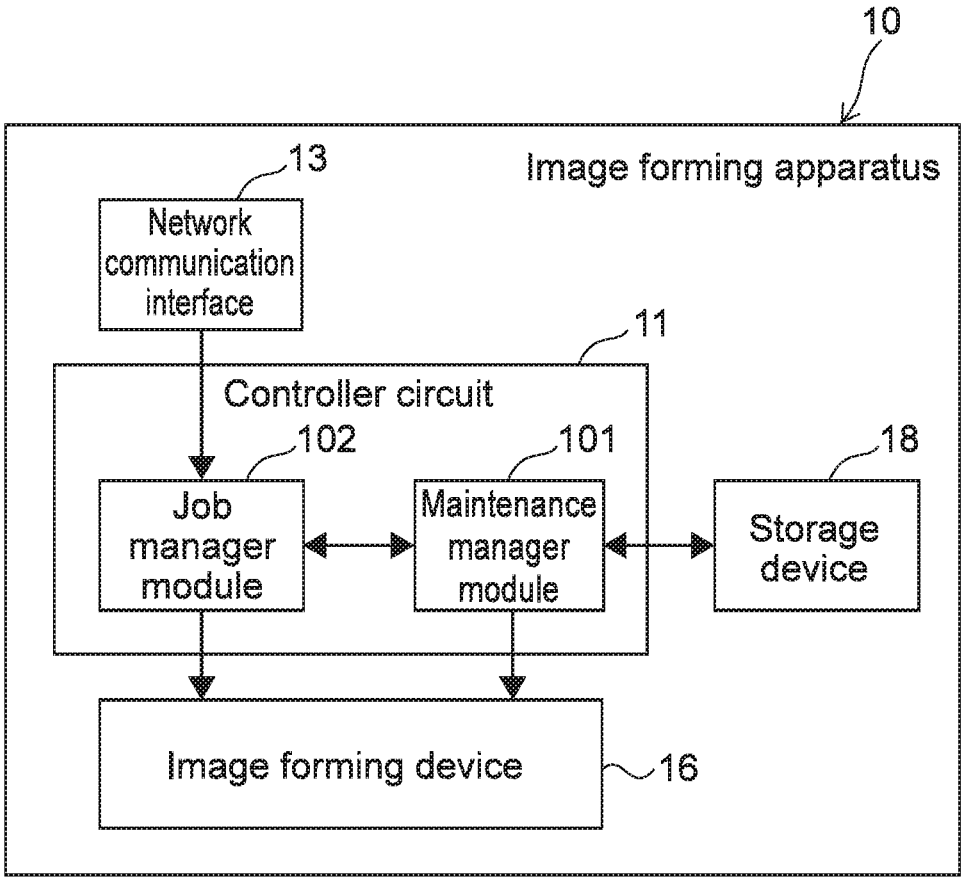
FIG. 2 shows a functional configuration of the image forming apparatus.

FIG. 2 shows a functional configuration of the image forming apparatus.

In the controller circuit 11 of the image forming apparatus 10, the CPU 11*a* loads an information processing program stored in the ROM 11*c* in the RAM 11*b* and executes the information processing program to operate as the maintenance manager module 101 and the job manager module 102.

3. Operational Flow of Image Forming Apparatus

Figure 3:
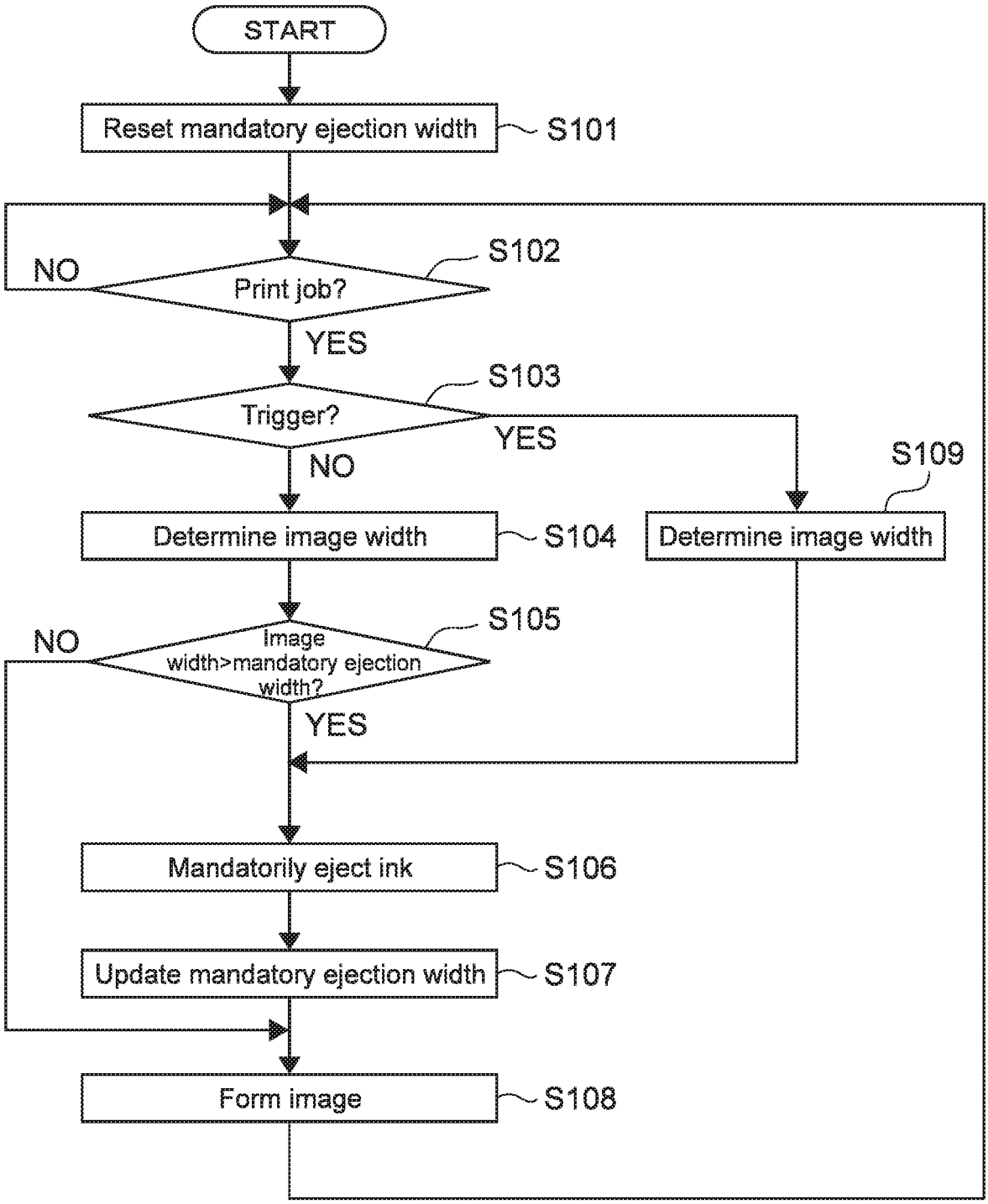
FIG. 3 shows an operational flow of the image forming apparatus.

FIG. 3 shows an operational flow of the image forming apparatus.

When the image forming apparatus 10 boots up, the maintenance manager module 101 sets (resets) zero as the size of the image width of mandatorily ejecting ink (hereinafter, referred to as mandatory ejection width), and stores zero as the size of the mandatory ejection width in the storage device 18 (Step S101).

The job manager module 102 obtains a print job (Step S102, YES). For example, the job manager module 102 receives a print job from a personal computer (not shown) via the network communication interface 13. The job manager module 102 renders printable data included in the print job, and generates image data (for example, bitmap data), which is data of an image to be formed on a medium.

The maintenance manager module 101 determines whether or not a certain trigger is detected (Step S103). For example, a "certain trigger" is a case where images are formed on a certain number (for example, several hundreds) of media after previous mandatory ejection, or a case where a certain time period (for example, several days) has passed after previous mandatory ejection.

Firstly, a case where the maintenance manager module 101 does not detect a certain trigger (Step S103, NO) will be described.

The maintenance manager module 101 determines the width (hereinafter, referred to as image width) in the line direction of an image (one page image) to be formed on the basis of the image data generated by the job manager module 102 (Step S104). The maintenance manager module 101 determines whether or not the determined image width is larger than the mandatory ejection width stored in the storage device 18 (Step S105). The maintenance manager module 101 determines that the image width is larger than the mandatory ejection width (Step S105, YES).

The maintenance manager module 101 determines an ink jet nozzle group, the ink jet nozzle group including multiple ink jet nozzles used to form the image having the determined image width out of the multiple ink jet nozzles. Typically, the "ink jet nozzle group" includes all the multiple ink jet nozzles used to form the image, and includes no ink jet nozzle different from the multiple ink jet nozzles used to form the image. Typically, the center point of the "ink jet nozzle group" is the center of the line head. Typically, the width of the "ink jet nozzle group" in the line direction is approximately the same as the image width.

Before forming the image on a medium, the maintenance manager module 101 controls the image forming device 16 to feed a medium and to mandatorily eject ink on the fed medium from the determined ink jet nozzle group (Step S106). The mandatory ejection target medium is a medium such as an unused sheet, and is different from a medium on which the image is to be formed. The mandatory ejection target medium may be a smallest-size medium on which it is possible to form the image by using the ink jet nozzle group. The maintenance manager module 101 updates the mandatory ejection width stored in the storage device 18 with the image width (Step S107). After the mandatory ejection, the job manager module 102 forms the image on a medium (Step S108).

Meanwhile, the maintenance manager module 101 determines that the image width is equal to or smaller than the mandatory ejection width (Step S105, NO). In this case, without mandatorily ejecting the ink (Step S106) (as a result, without updating mandatory ejection width (Step S107)), the job manager module 102 forms the image on a medium (Step S108).

After the job manager module 102 forms the image (one page image) (Step S108), the maintenance manager module 101 repeats the loop from Step S102 for each one page image in the print job (Step S102, YES).

Next, a case where the maintenance manager module 101 detects a certain trigger (Step S103, YES) will be described. As described above, for example, the "certain trigger" is a case where images are formed on a certain number (for example, several hundreds) of media after previous mandatory ejection, or a case where a certain time period (for example, several days) has passed after previous mandatory ejection. In other words, to "detect a trigger" means that it is necessary to mandatorily eject ink.

Accordingly, the maintenance manager module 101 mandatorily ejects ink without fail if a certain trigger is detected (Step S103, YES). In other words, the maintenance manager module 101 does not determine (Step S105) whether or not an image width is larger than the mandatory ejection width. In other words, the maintenance manager module 101 mandatorily ejects ink without fail irrespective of the fact that the image width is larger than the mandatory ejection width or not.

In short, if a certain trigger is detected (Step S103, YES), the maintenance manager module 101 determines the image width of an image (one page image) to be formed on the basis of the image data generated by the job manager module 102 (Step S109). Before forming the image on a medium, the maintenance manager module 101 controls the image forming device 16 to feed a medium and to mandatorily eject ink on the fed medium from the determined ink jet nozzle group, the ink jet nozzle group including multiple ink jet nozzles used to form the image having the determined image width (Step S106). The maintenance manager module 101 updates the mandatory ejection width stored in the storage device 18 with the image width (Step S107). After the mandatory ejection, the job manager module 102 forms the image on a medium (Step S108). The maintenance manager module 101 repeats the loop from Step S102 for each one page image in the print job (Step S102, YES).

4. Modification Example

When mandatory ejection is executed (Step S106), the maintenance manager module 101 may reset zero as the value (number or time) being a trigger origin.

5. Conclusion

If ink is not ejected from ink jet nozzles for a long period of time, moisture in ink may evaporate and ink viscosity may be increased. In such a case, an ink ejection volume and ink color may change, and the image quality may be reduced.

(1) To the contrary, according to the present embodiment, the image forming apparatus 10 mandatorily ejects ink from an ink jet nozzle group before forming the image, the ink jet nozzle group including multiple ink jet nozzles used to form the image (Step S106). As a result, before (immediately before) forming the image (Step S108), ink is mandatorily ejected from the ink jet nozzle group for maintenance of the ink jet nozzle group. So its print quality may not be reduced.

(2) According to the present embodiment, if the trigger is not detected (Step S103, NO), and if it is determined that the image width is larger than the mandatory ejection width (Step S105, YES), the image forming apparatus 10 mandatorily ejects ink from an ink jet nozzle group (Step S106) before (immediately before) forming the image (Step S108). As a result, ink is mandatorily ejected from the ink jet nozzle group including ink jet nozzles, from which ink is not mandatorily ejected before forming an image (Step S108) the last time, for maintenance of the ink jet nozzle group. So the image print quality may not be reduced more reliably. To the contrary, if it is determined that the image width is equal to or smaller than the mandatory ejection width (Step S105, NO), the image forming apparatus 10 may mandatorily eject ink (Step S106) after a trigger is detected (Step S103, YES). As a result, the number of times of mandatory ejection is not larger than the necessary number of times. So waste of ink, i.e., a consumable item, may be reduced.

(3) According to the present embodiment, the ink jet nozzle group includes all the multiple ink jet nozzles used to form the image. As a result, ink is mandatorily ejected from all the multiple ink jet nozzles used to form the image for maintenance of the ink jet nozzles. So the image print quality may not be reduced. According to the present embodiment, the ink jet nozzle group includes no ink jet nozzle different from the multiple ink jet nozzles used to form the image. As a result, ink is not mandatorily ejected from unused ink jet nozzles. So waste of ink, i.e., a consumable item, may be reduced.

(4) According to the present embodiment, the image forming apparatus 10 mandatorily ejects ink on a medium different from a medium on which an image is to be formed. As a result, for example, it may be possible to mandatorily eject ink with a simpler structure and in a shorter period of time than a structure in which ink is mandatorily ejected not on a medium but in a mandatory-ejection-dedicated tray. According to the present embodiment, the image forming apparatus 10 mandatorily ejects the ink on a smallest-size medium on which it is possible to form the image by using the ink jet nozzle group. As a result, waste of a medium, i.e., a consumable item, may be reduced because an unnecessarily large-size medium is not used.

(5) According to the present embodiment, the trigger is a case where images are formed on a certain number of media after previous mandatory ejection, or a case where a certain time period has passed after previous mandatory ejection. As a result, the image forming apparatus 10 mandatorily ejects ink regularly. So the image print quality may not be reduced more reliably.

It should be understood by those skilled in the art that various modifications, combinations, sub-combinations and alterations may occur depending on design requirements and other factors insofar as they are within the scope of the appended claims or the equivalents thereof

What is claimed is:

1. An image forming apparatus, comprising:

a line head including multiple ink jet nozzles arrayed in a line direction;

a storage device; and a controller circuit configured to determine an image width, the image width being a width of an image to be formed in the line direction, execute mandatorily ejection processing, the mandatorily ejection processing including mandatorily ejecting ink from an ink jet nozzle group before forming the image, the ink jet nozzle group including multiple ink jet nozzles used to form the image having the image width out of the multiple ink jet nozzles, and store the image width corresponding to the mandatorily ejection processing in the storage device as a mandatory ejection width, wherein the controller circuit is configured to execute the mandatorily ejection processing, if the controller circuit determines that the width of the image to be formed is larger than the mandatory ejection width stored in the storage device.

2. The image forming apparatus according to claim 1, wherein the controller circuit is configured to if a certain trigger is detected, determine the image width, execute the mandatorily ejection processing, and update the mandatory ejection width stored in the storage device with the image width, and if the trigger is not detected, if it is determined that the image width of the image to be formed is larger than the mandatory ejection width stored in the storage device, execute the mandatorily ejection processing, and update the mandatory ejection width stored in the storage device with the image width, and if it is determined that the image width of the image to be formed is equal to or smaller than the mandatory ejection width stored in the storage device, avoid the mandatorily ejection processing.

3. The image forming apparatus according to claim 2, wherein the trigger is a case where images are formed on a certain number of media after previous mandatory ejection, or a case where a certain time period has passed after previous mandatory ejection.

4. The image forming apparatus according to claim 1, wherein the ink jet nozzle group includes all the multiple ink jet nozzles used to form the image, and includes no ink jet nozzle different from the multiple ink jet nozzles used to form the image.

5. The image forming apparatus according to claim 1, wherein the mandatorily ejection processing includes, by the controller circuit, mandatorily ejecting the ink from the ink jet nozzle group on a medium before forming the image, the medium being different from a medium on which the image is to be formed and being a smallest-size medium on which it is possible to form the image by using the ink jet nozzle group.

6. The image forming apparatus according to claim 1, wherein the controller circuit is configured to if it is determined that the image width of the image to be formed is larger than the mandatory ejection width stored in the storage device, execute the mandatorily ejection processing, and update the mandatory ejection width stored in the storage device with the image width.

7. The image forming apparatus according to claim 1, wherein the controller circuit is configured to if it is determined that the image width of the image to be formed is equal to or smaller than the mandatory ejection width stored in the storage device, avoid the mandatorily ejection processing.

8. A non-transitory computer readable recording medium that records an image forming program executable by a controller circuit of an image forming apparatus, the image forming apparatus including a line head including multiple ink jet nozzles arrayed in a line direction, and a storage device, the image forming program causing the controller circuit of the image forming apparatus to determine an image width, the image width being a width of an image to be formed in the line direction, execute mandatorily ejection processing, the mandatorily ejection processing including mandatorily ejecting ink from an ink jet nozzle group before forming the image, the ink jet nozzle group including multiple ink jet nozzles used to form the image having the image width out of the multiple ink jet nozzles, and store the image width corresponding to the mandatorily ejection processing in the storage device as a mandatory ejection width, wherein the image forming program causes the controller circuit of the image forming apparatus to execute the mandatorily ejection processing, if the controller circuit determines that the width of the image to be formed is larger than the mandatory ejection width stored in the storage device.

9. The non-transitory computer readable recording medium according to claim 8, wherein the image forming program causes the controller circuit of the image forming apparatus to if it is determined that the image width of the image to be formed is larger than the mandatory ejection width stored in the storage device, execute the mandatorily ejection processing, and update the mandatory ejection width stored in the storage device with the image width.

10. The non-transitory computer readable recording medium according to claim 8, wherein the image forming program causes the controller circuit of the image forming apparatus to if it is determined that the image width of the image to be formed is equal to or smaller than the mandatory ejection width stored in the storage device, avoid the mandatorily ejection processing.

* * * * *